US005147298A

United States Patent [19]

Turner et al.

[11] Patent Number: 5,147,298

[45] Date of Patent: Sep. 15, 1992

[54] FEEDING APPARATUS

[75] Inventors: John J. Turner; Mary J. A. Turner, both of Liverpool; Peter Watt, Wirral, all of England

[73] Assignee: National Research Development Corporation, London, England

[21] Appl. No.: 680,170

[22] Filed: Apr. 3, 1991

[30] Foreign Application Priority Data

Apr. 6, 1990 [GB] United Kingdom ..... 9007890

[51] Int. Cl.[5] ..... A61J 9/00

[52] U.S. Cl. ..... 604/79; 604/77; 604/284; 215/1 A

[58] Field of Search ..... 604/77, 79, 284; 128/15, 207.14; 119/71; 215/1 A, 11.1

[56] References Cited

U.S. PATENT DOCUMENTS

| | | | |
|---|---|---|---|
| 1,024,422 | 4/1912 | Saenger | 128/207.14 |
| 1,074,313 | 9/1913 | Davis | 119/71 |
| 1,498,267 | 6/1924 | Hachman | 128/15 |
| 1,728,542 | 9/1929 | Hames | 604/77 |
| 3,504,666 | 4/1970 | Vireno | 604/77 |
| 3,875,940 | 4/1975 | Beuther | 604/77 |
| 3,908,665 | 9/1975 | Moses | 128/207.14 |
| 4,813,933 | 3/1989 | Turner . | |
| 4,865,021 | 9/1989 | Siderman | 604/77 |
| 4,966,580 | 10/1990 | Turner et al. . | |
| 5,057,077 | 10/1991 | Turner et al. . | |

FOREIGN PATENT DOCUMENTS

| | | | |
|---|---|---|---|
| 65363 | 11/1892 | Fed. Rep. of Germany | 604/79 |
| 4622 | of 1888 | United Kingdom | 604/79 |
| 2220363 | 1/1990 | United Kingdom . | |

*Primary Examiner*—Stephen C. Pellegrino
*Assistant Examiner*—Ralph A. Lewis
*Attorney, Agent, or Firm*—Cushman, Dabry & Cushman

[57] ABSTRACT

Apparatus for administering an ingestible oral fluid to a patient takes the form of an elongate tubular member (10) closed at the extremity of one end portion shaped as a hook (11), the hook having a hollowed outward projection (16) which is resilient at least over its area facing in the same general direction as the mouth of the hook, with this area also being formed with an orifice (17). The overall geometry of the apparatus is such that the hook passes over the lower mouth of the patient to locate and retain the projection or oral actuation, while the remainder of the member hangs across the jaw of the patient.

14 Claims, 1 Drawing Sheet

FEEDING APPARATUS

BACKGROUND OF THE INVENTION

1. Field of the Invention

This invention concerns feeding apparatus and more particularly such apparatus for administering oral fluids.

2. Description of the Prior Art

The maintenance of an adequate level of hydration is of fundamental importance to the physical well-being of the human body. Clearly, such maintenance can be problematical for an individual who is ill and because of physical or mental disability, has an impaired ability to drink normally. Under conventional good practice the fluid intake for the majority of patients in this category is individually administered by nursing personnel, while for the remaining minority an alternative intensive care approach involving an intravenous or naso-gastric tube is appropriate. However, the reality of such practice is that the majority demand for individual administration is time consuming and places an undue strain on nursing resources and this can lead, in turn, to the adoption of an alternative intensive approach inappropriately or, perhaps worse still, failure to maintain a fully adequate hydration level.

It has been proposed in Patent Specification GB-A-2181958, that this situation be improved by the provision of a device to facilitate the administration of oral fluid to a patient, such device comprising a nipple, a soft reticulate mouthpiece shaped to be received between the lips and the teeth or gums of the patient to hold the nipple over the patient's tongue, a container for the oral fluid, the container being at a higher level than the patient's head, and a tube leading from the container to the nipple, the latter containing a valve which prevents the fluid from flowing freely out of the nipple but which is operable by the sucking action of the patient so that the oral fluid flows out of the nipple so long as the patient continues to suck.

Also it has subsequently been proposed in Patent Specification GB-A-2202449 to cater for the situation of a patient unable to sustain a sucking action to the extent which is necessary, with use of the prior device, to maintain an adequate liquid intake. This later proposal is for apparatus comprising a nipple, means for holding the nipple in the patient's mouth, a container for the oral fluid, a tube leading from the container to the nipple, and means responsive to the patient sucking on the nipple for metering the quantity of fluid flowing out of the nipple. In a preferred form of this apparatus the metering means comprises a pump and the control means includes a sensor responsive to an initial suction—induced flow in the tube and adapted to switch on the pump for a predetermined period to supply to the nipple a quantity of oral fluid determined by such period.

More recently it has been proposed in Patent Specification GB-A-2220363 to improve this last apparatus, through reduced complexity and/or cost, by the provision of apparatus for administering oral fluid from a reservoir to a patient, which apparatus comprises: a chamber adapted to be held in the patient's mouth, the chamber having a fluid inlet opening and outlet opening, and a resilient wall; a tube connected between the chamber inlet opening and an associated fluid reservoir; and a valve connected in said tube to control fluid flow through the latter, the valve including a hollow housing formed with fluid inlet and outlet ports, and a valve member in said housing, which member is freely movable into and out of engagement with said outlet port respectively to close and open the same.

Continuing development of these proposals has led to yet further improvement by simplification, particularly in respect of the chamber of the last-mentioned apparatus and its adaptation for oral retention.

SUMMARY OF THE INVENTION

On the basis of this development the present invention provides apparatus for administering oral fluid from a reservoir by way of a tube, comprising an elongate tubular member shaped over one end portion to form a hook, the hook being closed at its free end and having partway therealong a radially outward projection, the projection being hollowed to communicate with said member, being resilient at least over its area facing in the same direction as said free end, and having an orifice formed in said area.

In use of this member, the hook serves to afford oral retention by disposition to pass over the lower lip and gum, teeth or denture into the mouth, with the remaining other end portion of the member extending downwardly from the mouth over the jaw. This disposition locates the projection in the mouth where it can be actuated by the tongue in similar manner to the chamber of the third specification above.

Suitably for such use, the hook is formed to follow a substantially planar curved path which continues from the member other end portion initially by turning in one sense and to one side of the longitudinal direction of such portion to form a first hook part, then turns in the opposite sense on said one side to form a second hook part, and lastly continues to form a third hook part which turns in said opposite sense on the other side of said longitudinal direction towards a reversal of such direction. Similarly, the projection extends from the third hook part, and it is preferably forwardly inclined relative to the hook free end, suitably at about 20° from the longitudinal direction of the member other end portion.

The tubular member preferably has a flattened cross-sectional form over at least that hook portion thereof adjacent the projection and to be located between the lips. Such a form is suitably of ovate shape of which the major dimension extends normally of the plane of the hook. This affords comfort and facilitates sealing between the lips during use. Comfort is also afforded by continuing such a form towards the hook free end and also over the projection. However at its other end portion the member is conveniently of circular cross-sectional form to facilitate communication with an associated tube extending to the reservoir. Preferably both of these ovate and circular forms are provided with the member exhibiting a smooth transition therebetween over an initial longitudinal portion of the hook.

The member, as so far developed, is preferably formed as a multi-walled construction and the projection by extension of one of such walls, with the thicknesses and physical properties being such that the projection has greatest elasticity, the other end portion of the member is flexible, and the hook is semi-rigid.

Use of the member will normally involve connection of the member with a fluid reservoir by way of a tube, the tube being operably connected with some means responsive to oral actuation of the projection to provide a metered supply of fluid. This means can be a valve such as described in the third Specification above, or a pump and associated sensor as described in the second such Specification.

BRIEF DESCRIPTION OF THE DRAWING

For clarification of the invention, the same is illustrated by way of example with reference to the accompanying drawings, in which.

DETAILED DESCRIPTION OF THE PRESENTLY PREFERRED EXEMPLARY EMBODIMENT

Figure 2:
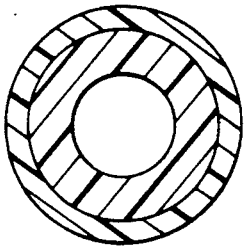
FIGS. 2 and 3 are cross sections of FIG. 1 taken respectively at II—II and III—III.
Figure 3:
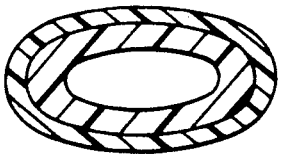

The illustrated embodiment comprises an elongate tubular member 10 which extends from an open end over about half its length normally in a generally rectilinear manner. Thereafter the member follows a planar curved path as noted above to form a hook 11 terminating in a closed end. The member is of circular cross-section over its initial length as shown in FIG. 2 and then changes smoothly to an ovate cross-section as shown in FIG. 3, with this change occurring between positions 12 and 13 representing the first hook part. In the embodiment it will be seen that the first hook part turns in one sense through an angle about 40° relative to the rectilinear part, and then in the opposite sense through a relative angle of about 180° through the second and third hook parts.

The member 10 is of two-walled construction with a thicker inner wall 14 and thinner outer wall 15. The inner wall is suitably of silicone rubber over the major part of its rectilinear length and then of low density polyethylene, heat formed to the required shape, with the whole being dipped in further silicone rubber to form the outer wall. The construction produces the flexible and semi-rigid portions described above.

The hook 11 has a projection 16 extending from partway along the third hook part and radially outwardly at an angle of about 20° with the longitudinal direction of the member, as represented by the initial portion thereof. This projection is effectively formed by continuation of the member outer wall 15, it is hollowed to communicate with the member, it has an ovate cross-sectional form with its major dimension extending normally of the plane of the hook, and it has an orifice 17 located substantially centrally in its major surface area facing towards the hook end. The projection is the most resilient part of the apparatus to facilitate oral actuation by the tongue to distort and compress the same.

Figure 1:
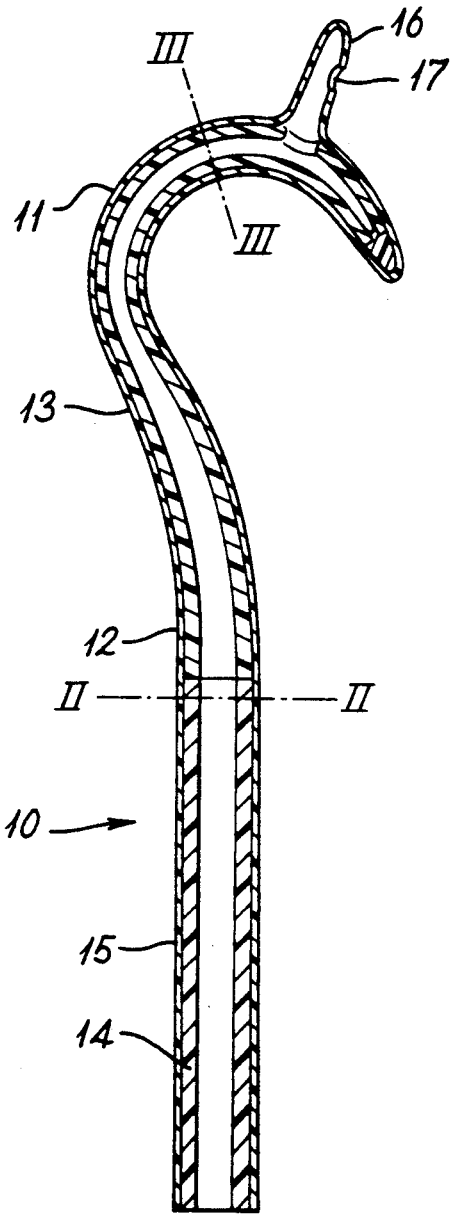
FIG. 1 shows in side view an embodiment of the presently preferred form of the proposed apparatus.

The embodiment is suitably approximately dimensioned to be 100 mm in overall length, with the inner and outer walls being respectively 3 mm and 2 mm thick and 8 mm overall diameter at II—II, progressing to overall ovate diameters of 10 mm and 5 mm at II–III. The projection similarly has a length of 15–20 mm and width of 5 mm as seen in FIG. 1, a wall thickness of 1 mm, and an orifice of 2.5–3.0 mm. The length of the hook from the projection to its free end, which length serves to stabilise the apparatus in the mouth in use, is about 15 mm and forms an angle of about 40° with the axial direction. The hook as a whole extends to about 15 mm on opposite sides of this direction.

Use and operation of the embodiment is described in the second and third Specifications referred to above and such description, taken with that at hand, will make it clear that the presently proposed apparatus is open to variation within the more general introductory discussion thereof above.

We claim:

1. An apparatus for use in administering ingestible oral fluid to a patient, comprising:

an elongate tubular member shaped over one end portion as a hook, said one end portion being closed at its free end; and a projection connected with said one end portion partway therealong to extend generally radially outwardly from said hook shape, said projection having an area facing in the same direction as a longitudinal direction of said free end, said projection being hollowed to communicate with an interior of said tubular member, being resilient over at least said area, and said projection has an orifice in said area;

said hook shape serving for disposition of said one end portion to pass over the lower lip and gum, teeth or denture of the patient to locate and facilitate retention of said projection in the patient's mouth, while the remaining other end portion of said member depends from the mouth across the patient's jaw.

2. An apparatus according to claim 1 wherein said one end portion is shaped to follow a substantially planar curved path which continues from said other end portion initially by turning in one sense and to one side of the longitudinal direction of said other end portion to form a first hook part, then turns in the opposite sense on said one side to form a second hook part, and lastly continues to form a third hook part which turns in said opposite sense on the other side of said longitudinal direction towards a reversal of such direction.

3. An apparatus according to claim 2 wherein said curved path turns through an angle of about 40° in said first hook part and about 180° in said second and third hook parts.

4. An apparatus according to claim 2 or 3 wherein said projection extends from said third hook part.

5. An apparatus according to claim 4 wherein said projection is elongate and extends in outwardly inclined manner relative to said longitudinal direction.

6. An apparatus according to claim 5 wherein said projection is inclined at an angle of about 20° relative to said longitudinal direction.

7. An apparatus according to claim 6 wherein said member has a length of about 100 mm. with about one half of such length shaped as said hook, and said projection has a length of 15–20 mm.

8. An apparatus according to claim 1 wherein said member has, adjacent to said projection, a cross-sectional shape of flattened form with the major dimension of such form extending normally of said hook shape.

9. An apparatus according to claim 8 wherein said flattened cross-sectional shape is ovate.

10. An apparatus according to claim 8 or 9 wherein said flattened cross-sectional shape extends along said member from said one end portion free end to a position beyond said projection.

11. An apparatus according to claim 8, 9 or 10 wherein said flattened cross-sectional shape extends over said projection.

12. An apparatus according to claim 1 wherein said projection is wholly resilient, while said member is less so.

13. An apparatus according to claim 12 wherein said member other end portion is flexible and said member one end portion is relatively rigid.

14. An apparatus according to claim 12 or 13 wherein said member is of multi-walled construction, at least over said one end portion, and said projection is formed by extension of one wall of such construction.

* * * * *